United States Patent [19]

Keefe

[11] Patent Number: 4,667,086

[45] Date of Patent: May 19, 1987

[54] HEATER ELEMENT FOR BLOW DRYERS, PAINT STRIPPERS AND THE LIKE

[75] Inventor: Richard A. Keefe, Wilmette, Ill.

[73] Assignee: North American Philips Corp., New York, N.Y.

[21] Appl. No.: 789,402

[22] Filed: Oct. 21, 1985

[51] Int. Cl.[4] ..... H05B 3/06

[52] U.S. Cl. ..... 219/532

[58] Field of Search ..... 219/532, 536, 537, 542, 219/364, 368, 369, 370, 374–376, 380–382; 338/280, 283, 284, 294, 301, 305, 303, 296, 300, 302, 304, 315, 317, 318, 319; 174/138 J, 154; 336/207

[56] References Cited

U.S. PATENT DOCUMENTS

| | | | |
|---|---|---|---|
| 707,244 | 8/1902 | Leonard | 338/280 X |
| 2,536,925 | 1/1951 | Forss | 219/542 X |
| 4,163,146 | 7/1979 | Meywald | 219/542 |
| 4,350,872 | 9/1982 | Meywald et al. | 219/376 |
| 4,357,521 | 11/1982 | Ohnmacht et al. | 219/375 |

*Primary Examiner*—L. T. Hix
*Assistant Examiner*—Brain W. Brown
*Attorney, Agent, or Firm*—Eugene I. Snyder

[57] ABSTRACT

A particularly efficient yet inexpensive and simple heat element for such appliances as blow dryers, paint strippers, heat guns, and so forth, consists essentially of a tightly crimped corrugated wire ribbon supported on a form in such a manner that its corrugations are generally perpendicular to the surface of the form. The resulting structure, which has an end-on appearance like that of a finned tube, efficiently radiates heat to a mass of flowing gas. A particularly preferred embodiment results when the form is intersecting mica plates.

12 Claims, 10 Drawing Figures

FIG. 1
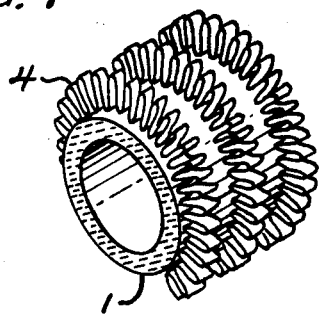
FIG. 2
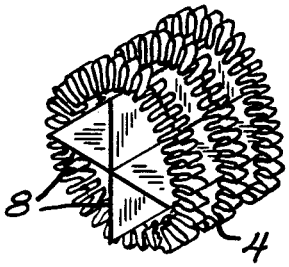
FIG. 3
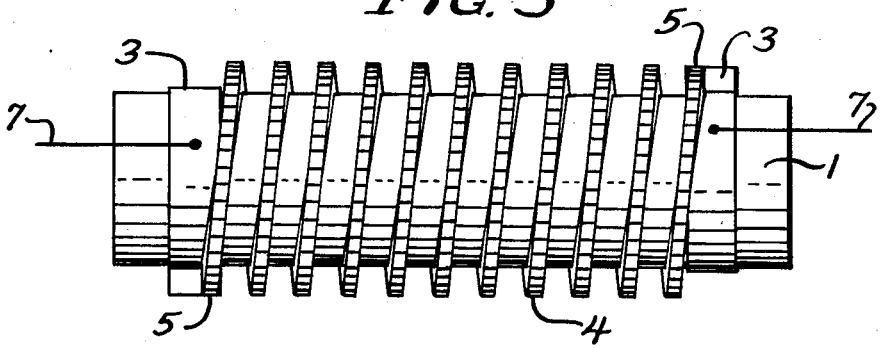
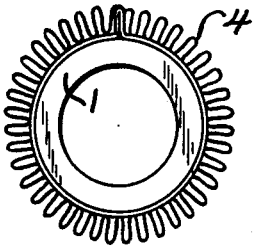
FIG. 4
FIG. 6
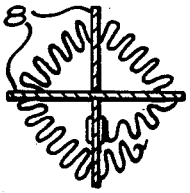
FIG. 5
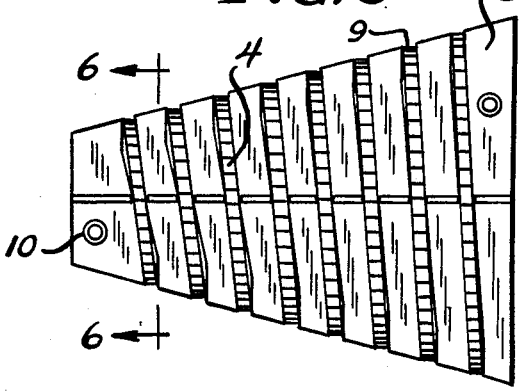

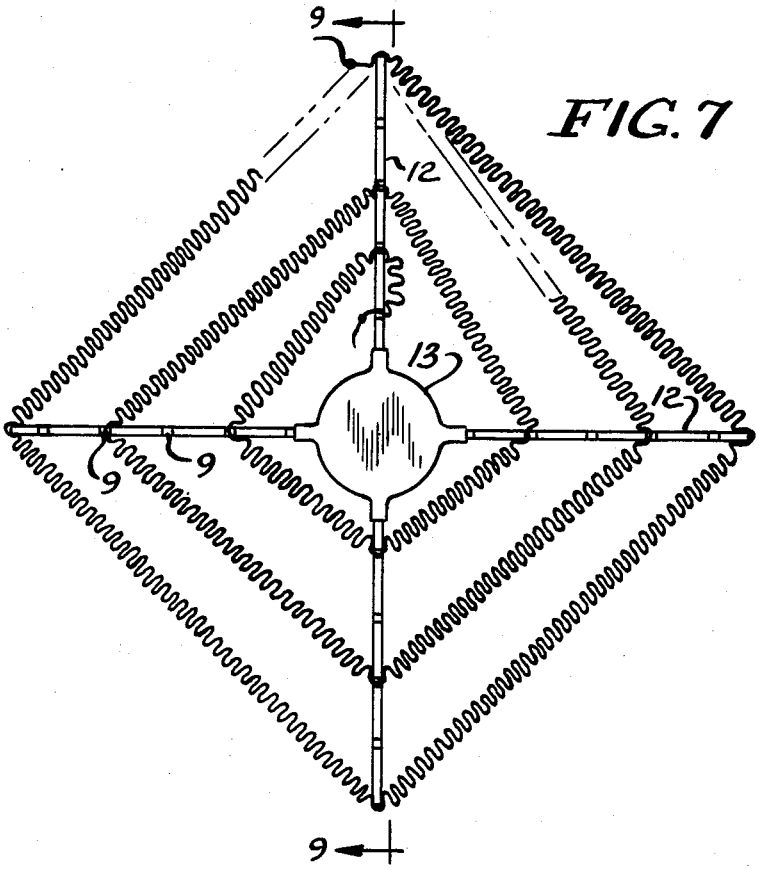
FIG. 7
FIG. 9
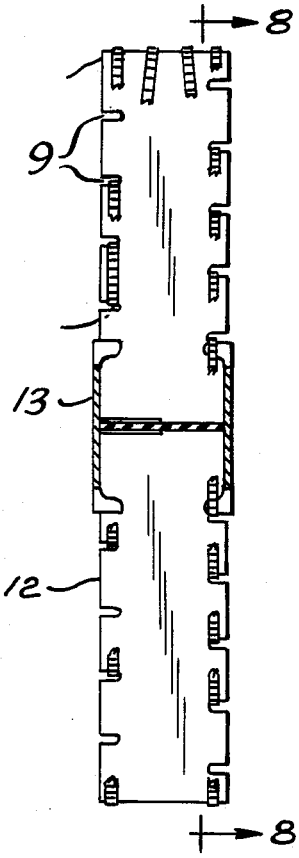
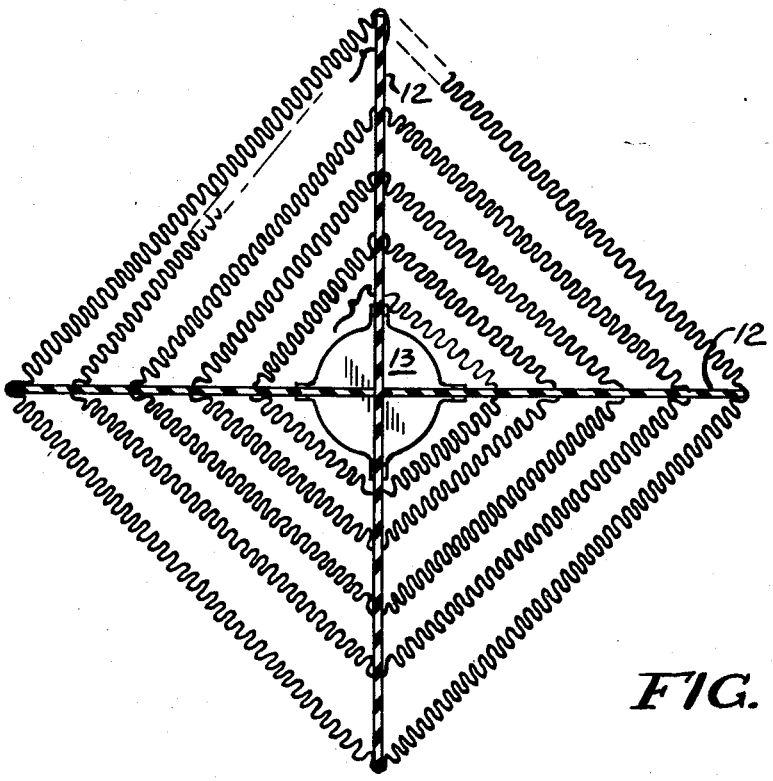
FIG. 8

HEATER ELEMENT FOR BLOW DRYERS, PAINT STRIPPERS AND THE LIKE

Although the use of an electrical resistance wire winding as a heating element has been known virtually since the advent of electrical devices, nonetheless its use remains undiminished with time. Such a heating element is the quintessence of simplicity—in design, in function, in operation—which unquestionably is largely responsible for its longevity. Such a heating element, as may be used in blow dryers, paint strippers, popcorn poppers, heat guns, hand dryers, room heaters, and industrial heaters, is the subject matter of my invention. For the purpose of simplifying exposition, reference will be made to assemblies used in blow dryers and paint strippers, but it is to be clearly understood that these are used in a representative capacity only.

The devices in question here have the common feature of continuously providing a flow of heated gas, generally hot air, as their thermal output. A mass of flowing gas is generally heated by passage over an energized resistance wire, with heat transfer from the wire to the gas provided by radiation, thermal conduction and convection. Quite typically, the resistance wire is wound on a form, which provides mechanical support and rigidity, and air, as the most typical gas, is caused to flow over and around the wire windings as by a fan. The shape of the form is not important, and often a circular shape is chosen for convenience with the wire wound directly on a cylinder. In other cases two flat, usually rectangular plates intersecting at right angles provides a form in the shape of a cross, with the resulting winding taking on the shape of a square. To aid in heat transfer and to provide the amount of heat required by such devices while reducing the bulk of the heater, the wire may be first tightly wound as a spiral, and the resulting spiral then may be wound on the form. Many variants of the theme developed above may be found in prior art heating elements for such devices, but the theme represented by my invention as described below presents advantages not previously available.

A critical feature in heater elements for the devices in question is the development of a relatively high wattage in a small volume. That is, the use of such devices demands a relatively high heat output, yet it is desirable to keep the devices as small as possible. The requirement of providing high wattage in a limited space has several adverse consequences. One is that element surface loading may become so high as to exceed the material specifications, or as is more often the case, the element surface loading may be sufficiently high to appreciably lower element life. For example, many heaters for the devices under discussion here operate with a loading of about 175 watts per square inch for the resistance wire winding, whereas for maximum life it is usually necessary to operate at a watt density of, say, under about 100 watts per square inch. Another disadvantage of high surface loading is that the temperature at which the wire operates may be so high as to appreciably decrease element life by accelerating its oxidation, which is a temperaturedependent process. Yet another result of excessive wire temperature is reduced heating efficiency which arises from the increase in resistance of the winding with temperature.

What is sought in a heater element for paint strippers, blow dryers, popcorn poppers, and the like is a compact unit which can provide about 1,500 watts at a watt density under 100 watts per square inch, and preferably under about 75 watts per square inch. Therefore, one object of my invention is to provide a heater assembly which affords 1,500 watts at a watt density under 100 watts per square inch, and preferably under about 75 watts per square inch. Another object is to make such a heater assembly as a compact unit. A further object is to provide an element so designed as to increase heat transfer from the wire to the flowing air mass, thereby utilizing the heat generated more efficiently and reducing the temperature of the wire winding. An aspect of this is a design which smooths the air flowing from a fan over the wire surface and does not make the flow turbulent. These latter two have the salutory effect of increasing wire longevity by reducing oxidative deterioration as well as mechanical stress from thermal fatigue, and increasing the efficiency of heat generation by decreasing the resistance of the wire winding. My invention is a heater element which meets the aforementioned objects and possesses all of these advantages. The invention herein is a heater element which is more efficient than present devices, but which can be produced at a cost approximately equal to the most rudimentary of such devices and a cost significantly less than many other currently used heaters. The invention herein thus overcomes all the stated disadvantages of the prior art heater elements while offering substantial savings in production and operating cost.

SUMMARY OF THE INVENTION

The purpose of this invention is to provide an inexpensive but efficient heater assembly for heating a flowing mass of gas as is used in such appliances as blow dryers, paint strippers, and popcorn poppers. One embodiment of the assembly is essentially a corrugated resistance ribbon supported on a form so that the axis of the corrugations is generally approximately perpendicular to the surface of the form.

DESCRIPTIONS OF THE FIGURES

FIG. 1 is an isometric view through a middle section of a corrugated resistance ribbon wound on a cylindrical form.

FIG. 2 is an isometric view through a middle section of a corrugated resistance ribbon wound on intersecting plates.

FIG. 3 is a side view of a heater element on a ceramic cylindrical form.

FIG. 4 is an end view of the above heater element.

FIG. 5 is a side view of a heater element on stepped intersecting mica plates.

FIG. 6 is a section of the above heater element through 6—6.

FIG. 7 is a front view of a heater assembly where the form is a plurality of radially extending members attached to a hub.

FIG. 8 is a section of the above heater assembly through 8—8 looking toward the back of the assembly.

FIG. 9 is a side view of a radially extending member.

DESCRIPTION OF THE INVENTION

Figure 10:
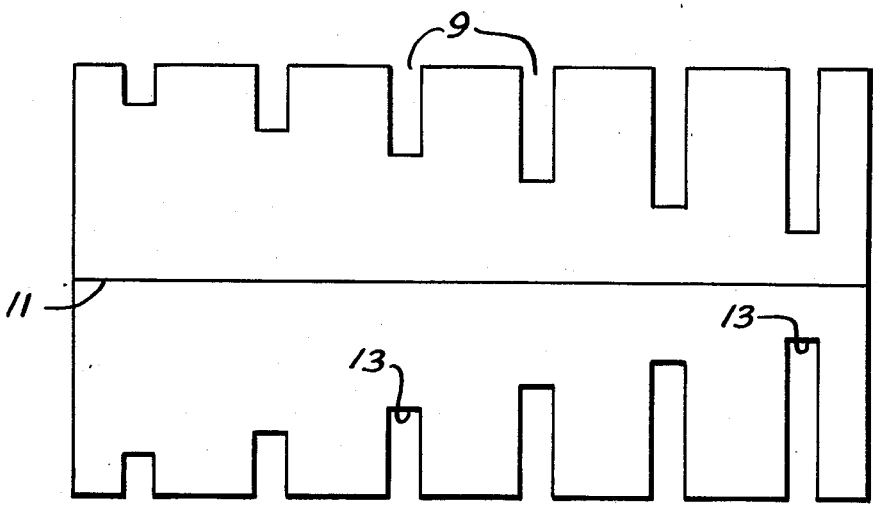
FIG. 10 is a side view of an intersecting plate in an alternate embodiment of a pyramidal form.

In its most general manifestation the heater element of my invention is a corrugated resistance ribbon shaped by a form which gives it support and which is placed in a mass of flowing gas so that the gas flow is parallel to the width of the ribbon. In more specific embodiments, the heater element which is my invention is essentially a corrugated resistance ribbon supported on a form. Not any orientation of the ribbon will afford the advantages presented by my invention, and it is essential that the ribbon is supported on the form with its corrugations generally perpendicular, or approximately so, to the surface of the form. Nor will any corrugated ribbon suffice in the practice of this invention, for it is essential that the ribbon be crimped so as to afford a corrugated ribbon whose length is no more than about 1/2.5 that of uncorrugated ribbon. A corrugated ribbon with such properties will be called a tightly crimped ribbon.

The function of the form on which the corrugated resistance ribbon is wound is to provide mechanical support, and occasionally rigidity. Consequently, the shape of the form is unimportant, although a circular shape commonly is used for convenience. Often the form does not present a continuous surface but instead merely provides a multi-point support, as, for example, is represented by two plates intersecting at approximately right angles to give a structure in the shape of a cross, as in FIG. 2. Where the form merely provides multi-point support it is recommended that the corrugated ribbon be stretched tautly between two support points to assist in mechanical stability of the ribbon itself. Similarly, materials from which the form is fabricated also are unimportant so long as the form functions to afford mechanical support and rigidity under the operating conditions of the heater, although the materials of necessity need to be electrically nonconductive.

A hollow ceramic cylinder, as depicted in FIG. 1, may be used advantageously for its properties of high rigidity under thermal extremes, excellent resistivity, and low heat capacity while being a good thermal conductor. When used in an embodiment of my invention heat is not only efficiently transferred from the resistance ribbon directly to the flowing gas, but also is efficiently transferred to the ceramic cylinder to afford a relatively large heated surface on both the outside and inside of the cylinder, thereby leading to increased efficiency in heat transfer to gas flowing over and through such a cylinder.

Another form used in the trade consists of mica plates intersecting at approximately right angles. Such a form provides relatively unimipeded gas flow and essentially provides a resistance ribbon totally immersed in the gas stream. What needs to be recognized and stressed is that many forms, differing in design and materials of construction, are possible and are known in the art, but that the forms per se are not at the core of my invention. It is intended that my invention applies to all usable forms even though some may be more desirable than others.

The core of my invention is a corrugated resistance ribbon supported on a form in a manner such that the corrugations of the ribbon are generally approximately perpendicular to the surface of the form. This is depicted for the case of a cylindrical form in FIG. 1 and for the case of the form from two intersecting flat plates in FIG. 2. It is essential for the success of my invention that the corrugated wire ribbon be supported so that the corrugations are generally perpendicular to the surface of the form. Such an orientation affords a heating element whose appearance is somewhat analogous to a finned tube structure, where the fins serve to radiate heat away from the central core, and in fact the purpose of the chosen orientation is precisely to afford efficient and effective heat transport from the ribbon to the surrounding flowing gas. The combination of high surface area of resistance wire and the orientation of the corrugated ribbon to give a finned structure achieves the aforementioned advantages in an unprecedentedly simple yet economical manner.

It is also essential for the success of my invention that the corrugated ribbon be crimped to a ratio of at least 2.5:1, preferably at least 3.5:1, and even more preferably at least 4.0:1. What is meant by a ratio of, e.g., "2.5:1" is that a length of 2.5 inches of flat ribbon is crimped, or corrugated, to a length of 1 inch. That is, uncorrugated ribbon which is 2.5 inches long becomes corrugated ribbon only 1 inch long. If the corrugated ribbon is crimped to a ratio of at least 2.5:1 it is referred to as tightly crimped ribbon, in contrast to ribbon with a crimp ratio of less than 2.5:1 which is referred to as loosely crimped ribbon. The reason tight crimping is essential to the success of my invention is that the heater assemblies discussed herein need to be compact, and if loosely crimped corrugated ribbon is used the length of ribbon required to afford the desired wattage increases the size of the heater assembly to the point where it is either not usable or impractical for the devices in question. It is clear that one needs only one-third as long a piece of corrugated ribbon with a crimp ratio of, say, 4.5:1, to afford a heater of the same wattage as one with a similar corrugated ribbon but with a crimp ratio of only 1.5:1.

In its most general aspect, my invention is a tightly crimped corrugated resistance ribbon placed in a mass of flowing gas so that the direction of gas flow is generally parallel to the width of the ribbon. What my invention provides is an efficient method of heating a mass of flowing gas by flowing said gas over an electrically energized, tightly crimped corrugated resistance ribbon and in a direction generally parallel to the width of said ribbon. The ribbon, being energized, is hot and the combination of tight corrugations and direction of gas flow provides particularly efficient heat transfer to the gas mass over a relatively short length. In this aspect of my invention it is better appreciated that the geometrical design and appearance of the heater is irrelevant, subject to the constraints that gas flow be parallel to the width of a tightly crimped ribbon.

That the corrugated resistance ribbon heater of my invention operates at a substantially lower surface loading than a wire wound heater can be demonstrated quite readily. Resistance wire and ribbon of the same material are readily available, and when the wire and ribbon have equal cross-section their unit resistance, i.e., resistance per unit length, and unit weight will be equal. Some typical properties of such materials are given below:

Wire:

0.072" diameter (B&S 13), 0.1568 ohms/ft, surface area 2.713 $in^2$/ft.

Ribbon:

3/32×0.045" (B&S 17), 0.1547 ohms/ft, surface area 3.329 $in^2$/ft.

⅛×0.036" (B&S 19), 0.1506 ohms/ft, surface area 3,864 $in^2$/ft.

Using subscripts a and b to designate the wire and ribbon, resp., and using the wellknown relation between power, P (wattage), voltage, V, and resistance, R, coupled with the resistance per unit length (R/L) given above, $$P_a = V_a^2/[(R/L)_a L_a] \quad P_b = V_b^2/[(R/L)_b L_b]$$

Since the voltage will be the same in all cases, the requirement that the ribbon and wire deliver equal wattage requires $P_a = P_b$, or $$R_a L_a = R_b L_b$$

and $$(R_a/R_b) = (L_b/L_a)$$

Comparing the wire and $\frac{1}{8}''$ ribbon, $$(L_b L_a) = 0.1568/0.1506 = 1.041,$$

or to deliver equal wattage the length of ribbon must be 4% longer than that of the wire. But for such a length of ribbon the ratio of surface areas of ribbon to wire is $$(1.041 \times 3.864)/2.713 = 1.483.$$

That is, the surface area of the ribbon is almost 50% greater than that of the wire to deliver the same wattage, which is to say that the surface loading of the ribbon is correspondingly less than that of the wire.

A similar comparison of the wire to the 3/32" ribbon leads to the result that for equal wattage the length of the ribbon must be 1.014 that of the wire, with the surface area of ribbon 1.244 that of the wire.

The particular measurements of the corrugated ribbon are not important so long as the ribbon is tightly crimped, as defined above. Where the heater elements are of modest wattage the ribbon is relatively thin and is shaped without difficulty. Where the element requires a ribbon of appreciable thickness the nature of the wire often requires that the radius of curvature in the corrugation be some minimum multiple of ribbon thickness, but this will be appreciated by the skilled artisan as inherent in the material used. Similarly, the relation between corrugation depth, width of the ribbon, and corrugation pitch is susceptible to wide variation, the choice of which may vary depending on the kind of material used, the intended use of the heater, the heater size, and so forth.

The two ends of the corrugated ribbon on the form are connected to electrical leads which energize the ribbon, thereby providing necessary electrical power. Connection of the electrical leads may be made by any suitable means. For example, a grommet, often of conducting material, may be placed on either end of the form and each end of the ribbon may be firmly attached to the grommets to give a mechanically strong connection with low electrical resistance. The electrical leads may then be connected to each grommet, each connection being mechanically strong and with little electrical resistance. Many of the methods of connecting electrical leads to the ribbon are known and this aspect will not be further discussed here.

A particularly favored embodiment of my invention is a heater element consisting of a tubular ceramic form with compression bands at each end, a tightly crimped corrugated wire ribbon wound thereon with its long axis generally approximately perpendicular to the surface of the tubular ceramic, and with the ends of the ribbon attached to the compression bands to afford a mechanically strong connection with low electrical resistance. This embodiment is depicted in FIG. 3 which is an isometric view of the heater assembly showing all its elements.

The tubular body, 1, is a ceramic with quite distinct properties. In particular, the ceramic has a softening point no less than about 2000° to ensure that the heater assembly is adaptable to relatively high wattages. The ceramic must also be a good thermal conductor with low heat capacity. This combination assures rapid heating (and cooling) with maximum efficiency. The ceramic needs to be a good electrical insulator. Finally, the requisite tubular structure should be able to be readily fabricated, preferably by extrusion, with a reasonable degree of precision. Illustrative of the ceramic materials which can be used in the practice of this invention are alumina, beryllia, titania, steatite, forsterite, cordierite, zirconium silicates, aluminum silicates, and lithia, with alumina being a preferred material because of its relatively high thermal conductivity and beryllia, titania, and lithia being somewhat preferred. In some cases electrical porcelains may be utilized.

Near each end of the ceramic tube are compression bands, 3, which tightly grip the surface of the ceramic tube. Such bands are made of electrically conductive material and preferably have a spring temper. That is, the bands can be expanded so that they can be easily slipped onto the ceramic tube, but once on the bands fit very tightly and are essentially unmovable.

Between the bands is wrapped a corrugated ribbon, crimped to a ratio of at least 2.5:1, of resistance wire, 4. For any given resistance wire and ceramic tube the number of turns and the resistance of the ribbon per unit length (unit resistivity) will determine the heater wattage. One advantage of this heater assembly is its enormous versatility, heaters from 500 to 2000 watts are able to be constructed from only two sizes of ceramic tubes merely by varying the number of turns and the unit resistivity of the wire.

Each terminus, 5, of the resistance winding is firmly attached to the compression bands. Such attachment is both a good mechanical connection, so as to provide a strong, rigid structure, and a good electrical connection so that there is low electrical resistance in the heater everywhere but in the resistance windings. A good mechanical and electrical connection can be made simultaneously be welding each terminus to the cmpression band, although other means of connection are not intended to be excluded.

Two electrical leads complete the device, with each lead, 7, connected directly to a compression band. As stated above, such connection must be mechanically strong and give rise to little or no electrical resistance. As above, spot welding the lead to the band, especially at a point different from the connection, 5, of the resistance winding, affords such a connection.

Another especially favorable embodiment of my invention is one where the tightly crimped corrugated resistance ribbon is wound in a stepped fashion. In this embodiment each succeeding turn of the spiral is at a different distance from the center of the form on which it is wound, so that in the ideal case of a completely non-turbulent flow of a gas over the heater a different plate of gas encounters each new turn of ribbon. Ideally, this means that each section of ribbon transfers its heat to a completely unheated volume of gas, thereby maximizing heat transfer efficiency.

Several benefits accrue from this embodiment. By not winding the corrugated ribbon on a single plane the air flow wipes each turn with cooler air than if all the ribbon were wound on the same plane. A second benefit is increased element life, because the first turn is not heating the second one, and so on, until the hot air flowing over the last turn is so hot as to remove little heat, causing the turn to operate at a particularly high temperature leading to premature failure. Yet another benefit is that the output stream of air has a relatively homogeneous temperature distribution as contrasted with an uneven temperature distribution characterized by hot spots surrounded by cooler areas.

One particular design of this latter embodiment is shown in FIG. 5, which shows a corrugated ribbon wrapped on a pyramidal form of intersecting plates. This design is similar to that in FIG. 2, except that the transversely intersecting plates are not individually rectangular but are triangular sections, or if rectangular the plates have slots from their outer edge toward the intersection of the plates, the terminii of the slots so placed as to trace out a triangular section.

In greater detail, the plates of this embodiment may be of any electrically non-conductive material which retains its structural integrity at operating temperatures, and one such material is mica. Each of the plates, 8, is generally a triangular section, so that when the plates intersect transversely the completed form is pyramidal. Alternatively, the plates can be rectangular (or any other shape) with slots, 9, running from opposite edges toward the line of intersection, 11, as represented in FIG. 10. The terminii, 13, of the slots trace a generally triangular section, and the ribbon is supported at the terminii so as to give a generally pyramidal appearance to the resulting heater element. A corrugated resistance ribbon, 4, crimped to a ratio of at least 2.5:1, is wound on the form with the longitudinal axis of the ribbon approximately perpendicular to the surface of the form, with a sufficient number of turns to afford a unit of the desired wattage. To ensure that each turn of the winding remains on a different plane there needs to be means for retaining the ribbon in a fixed position. One such means are slots, 9, cut into each of the plates so that the ribbon winding is somewhat recessed but each turn is held firmly in a relatively fixed position. Each terminus, 5, of the resistance winding is then firmly mechanically attached to the form by appropriate means. One such means is by welding to a grommet, 10, placed at or near each end of the form in proximity to the ribbon terminii. Another means, albeit indirect, is by welding to a wire which ultimately is attached to some part of the form. The particular means used is well known in the art and not important for the successful practice of my invention; accordingly, many variations on my basic theme are possible, all of which are intended to be encompassed by my invention Yet another generic class containing many variants of heater assemblies is one where the form consists of a plurality of radially extending members attached to a hug, i.e., a plurality of spokes, with one or more turns of corrugated wire ribbon supported in one or more planes with its corrugations generally approximately perpendicular to the hub. The radially extending members have means for supporting the ribbon which also maintain it in a relatively fixed position. Each terminus of the ribbon is firmly mechanically attached to the form by suitable means, with the points of attachment also generally serving as points of electrical connection to leads which energize the ribbon. Although FIGS. 7–9 depict a particular embodiment, it is to be understood that this is only one of many embodiments within a generic class, all of which are intended to be encompassed within my invention.

The form of the heater assembly has a hub to which are attached a plurality of members, 12, radially extending outward from said hub. FIGS. 7 and 8 show four such members, but it is to be clearly understood that assemblies with a greater or lesser number are contemplated as being within the scope of this invention, since the number used is not critical to the success of this invention and is a mere matter of choice.

As variable as is the number of radially extending members is the geometrical shape of these members, for their sole function is to act as a support for the corrugated wire ribbon and any shape that accomplishes this purpose is satisfactory. FIG. 9 depicts a member which is generally rectangular in shape with slots, 9, cut into its edges to support the ribbon and maintain each turn in a relatively invariant position. As is shown more clearly in FIG. 7, the ribbon, crimped to a ratio of at least 2.5:1, is inserted into and strung between the slots, the slots being radially so spaced that the ribbon spirals outward toward the periphery of the member. The number of turns of ribbon is also variable, thereby affording a range of wattages. The ribbon also can be supported on both edges of the member, so as to give separate planes of corrugated resistance ribbon which may be electrically distinct as well. That is, each plane of ribbon may be a different circuit. FIG. 8 is a rear view of an example of such an assembly, which also shows that the spacing of the winding can be different on each plane. Each terminus of the ribbon is then firmly mechanically connected to the form, generally to the radially extending members, by suitable means.

Another type of radially extending member has a rod-like appearance with spaced-apart crossed members on which the resistance ribbon may be supported. In this embodiment the members resemble masts of a boat, and many other generically similar embodiments will occur to the skilled worker.

What is claimed is:

1. A heater element with a watt density less than about 100 watts per square inch consisting essentially of a corrugated wire ribbon supported on a form defining an outer surface where the wide surface of said ribbon is adjacent to and generally parallel to the outer surface of said form and where the corrugations are perpendicular to and extend outwardly away from the outer surface of said form, with the ribbon being crimped to a ratio of at least 3.5:1.

2. The heater element of claim 1 where the form is a cylinder.

3. The heater element of claim 1 where the form consists of two transversely intersecting plates.

4. The heater element of claim 1 where the ribbon is wound on a form with each succeeding turn of the winding being on a different plane.

5. A heater assembly consisting essentially of a ceramic tube, compression bands tightly fitted on the outer surface of the tube and placed transversely to its long axis, a first band being adjacent to one terminus of the tube and a second band being adjacent to the other terminus, a corrugated ribbon of resistance wire wound on and around the tube where the wide surface of said ribbon is adjacent to and generally parallel to the surface of said tube and where the corrugations are perpendicular to and extend outwardly away from the surface of said tube, with the ribbon being crimped to a ratio of at least 3.5:1 and where said heater assembly has a watt density less than about 100 watts per square inch, with the ribbon wound between said bands with one terminus of said ribbon connected electrically and mechanically to the first band and the other terminus of the ribbon connected electrically and mechanically to the second band, a first electrical lead connected electrically and mechanically to the first band, a second electrical lead connected electrically and mechanically to the second band, each of said electrical lead connections being at a point on the band separate from the point of connection of the resistance wire.

6. The assembly of claim 5 where the ceramic is selected from the group consisting of alumina, beryllia, titania, steatite, forsterite, cordierite, zirconium silicates, aluminum silicates, and lithia.

7. The assembly of claim 6 where the ceramic is alumina.

8. A heater assembly consisting essentially of two transversely intersecting plates, each plate being a triangular section and the plates intersecting as to give a pyramidal form generally defining a surface, a corrugated ribbon of resistance wire wound on the form in a plurality of turns where the wide surface of said ribbon is adjacent to and generally parallel to the surface defined by said form and where the corrugations are perpendicular to and extend outwardly away from the surface defined by said form, with the ribbon being crimped to a ratio of at least 3.5:1 and where said heater assembly has a watt density less than about 100 watts per square inch, means for retaining the turns in a relatively fixed positions, and means for mechanically attaching each end of the ribbon to the form.

9. A heater assembly consisting essentially of a hub, a plurality of radially extending members attached to said hub, the terminii of said members generally defining a first surface, a corrugated ribbon of resistance wire strung between and supported by said members where the wide surface of said ribbon is adjacent to and generally parallel to the first surface and where the corrugations are perpendicular to and extend outwardly away from the first surface, with the ribbon being crimped to a ratio of at least 3.5:1 and where said heater assembly has a watt density less than about 100 watts per square inch, means for retaining each turn of corrugated ribbon in a relatively fixed position, and means for mechanically attaching each end of the ribbon to the form.

10. The heater assembly of claim 9 where said members are generally rectangular in shape.

11. The heater assembly of claim 9 where the turn retaining means are slots cut into the edge of the members.

12. A method of heating a mass of flowing gas comprising flowing said gas over an electrically energized corrugated resistance ribbon, said ribbon being crimped to a ratio of at least 3.5:1, in a direction generally parallel to the width of the ribbon.

* * * * *